United States Patent [19]

Cassell

[11] 4,191,246

[45] Mar. 4, 1980

[54] DEVICE TO REDUCE LOCAL HEAT FLUX THROUGH A HEAT EXCHANGER TUBE

[75] Inventor: Don S. Cassell, Chattanooga, Tenn.

[73] Assignee: Combustion Engineering, Inc., Windsor, Conn.

[21] Appl. No.: 17,649

[22] Filed: Mar. 5, 1979

[51] Int. Cl.[2] ..... F28F 13/08; F28F 9/00

[52] U.S. Cl. ..... 165/134 R; 165/162

[58] Field of Search ..... 165/134, 162, 174

[56] References Cited

U.S. PATENT DOCUMENTS

| | | | |
|---|---|---|---|
| 1,802,766 | 4/1931 | Kerr | 165/134 |
| 3,503,440 | 3/1970 | Romanos | 165/162 |
| 3,610,329 | 10/1971 | Markert et al. | 165/134 |
| 3,726,339 | 4/1973 | Ash | 165/134 |
| 3,916,990 | 11/1975 | Ruhe et al. | 165/162 |
| 4,114,684 | 9/1978 | Jenis et al. | 165/162 |

FOREIGN PATENT DOCUMENTS

| | | | |
|---|---|---|---|
| 509187 | 1/1955 | Canada | 165/134 |
| 1507833 | 12/1974 | United Kingdom | 165/134 |

*Primary Examiner*—Sheldon Richter

*Attorney, Agent, or Firm*—Robert L. Olson

[57] ABSTRACT

Apparatus for reducing the heat flux in a localized area of a heat exchange tube, by placing a sleeve inside of the tube, creating a gap, or dead space, which fills with stagnant water, between the sleeve and inner tube wall. This reduced heat transfer will considerably reduce or prevent steaming on the outer side of the tube, thereby minimizing or preventing any solids from separating out at this location.

5 Claims, 5 Drawing Figures

DEVICE TO REDUCE LOCAL HEAT FLUX THROUGH A HEAT EXCHANGER TUBE

BACKGROUND OF THE INVENTION

In shell and tube heat exchangers, such as nuclear steam generators, tube supports are used to minimize tube vibration induced by the fluid flowing on the shell side of the exchanger. These tube supports may be drilled plates, machined plates with various clearances around the tube or lattice supports built from metal strips or bars. In any event, there exists areas of tight clearance between the tube and support which can be referred to as crevices. In many cases, the shell side fluid, which is the fluid being heated, in flowing through the crevices is partially or wholly evaporated by the heat transferred from the tube side fluid to the shell side fluid. One consequence of the evaporation process is that the concentration of dissolved solids in the liquid phase may reach the saturation limit so that further evaporation of water will result in precipitation of solids on the tube or plate surfaces. The crevice formed by a tube and the support is especially vulnerable to high solids deposition due to part or total evaporation of the water as it flows through the crevice. The solids accumulation in the crevice is undesirable, as it can lead to complete blockage of flow through the crevice, which increases shell side pressure drop, and may induce localized tube corrosion or other phenomena which could reduce the service life of such tube.

SUMMARY OF THE INVENTION

In accordance with the invention, a sleeve is positioned and secured inside a tube of a nuclear steam generator at a location adjacent to a tube support member. The sleeve is of small enough dimension that a gap exists between the sleeve and the inner wall of the tube, which gap is filled with stagnant water, forming an insulation barrier. This reduces the heat flux in the crevice region between the tube and tube support member, thereby diminishing the amount of liquid evaporated and thus minimizing the amount of solids deposited in the crevice. The flow inlet end of the sleeve is rolled into the tube in order to hold it in position, and drain holes are provided so that water is not trapped therein when the unit is not operating.

DESCRIPTION OF THE PREFERRED EMBODIMENT

Figure 1:
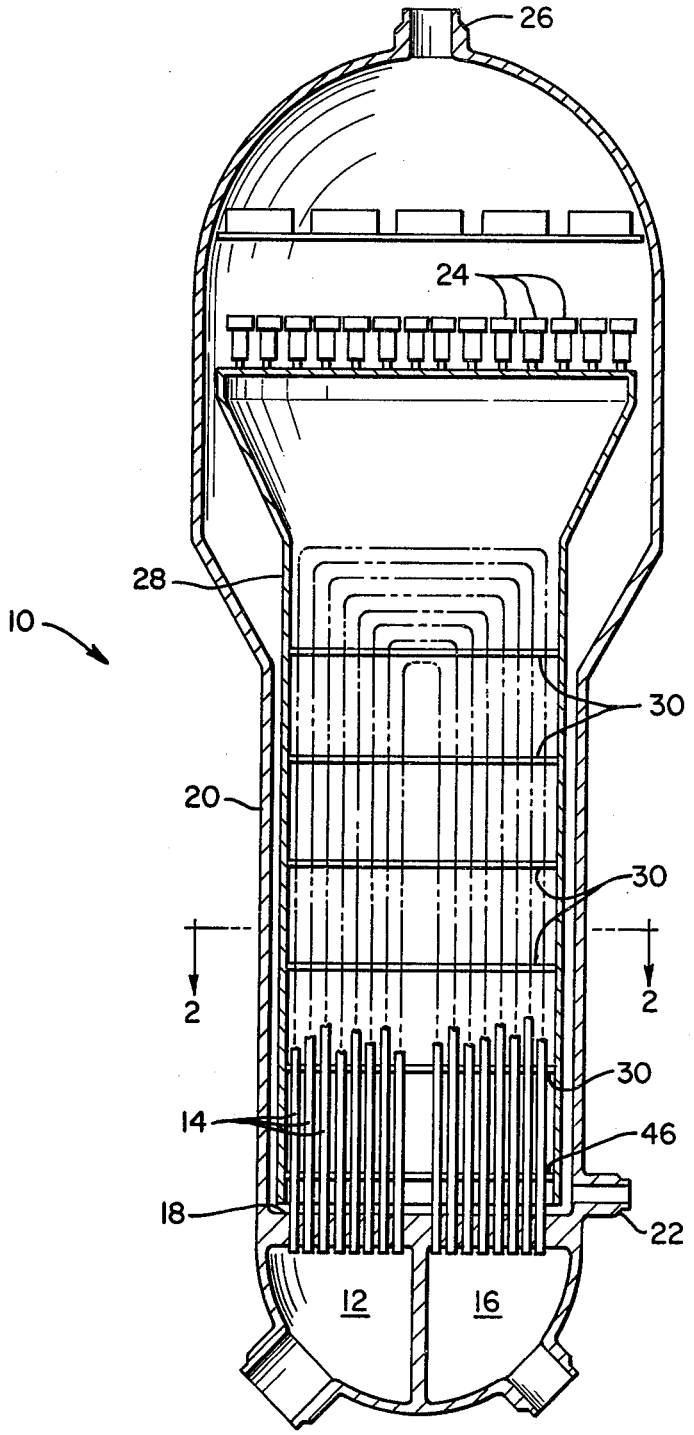
FIG. 1 is an elevational view of a steam generator incorporating the invention.

Looking now to FIG. 1 of the drawing, numeral 10 denotes a nuclear steam generator in which heating fluid, being water at high temperature, flows from inlet manifold 12, through tubes 14, and out of the outlet manifold 16. All of the tubes 14 are secured at their bottom ends to a tube sheet 18. The inlet fluid, generally being water below saturation temperature, enters the shell 20 through the inlet 22, mixes with the recirculatory fluid while flowing downwardly through the annular space between the shell 20 and shroud 28, thence upwardly through the tube bundle 14, absorbing heat in doing so, forming a mixture of steam and water. The separators 24 at the top of the vessel separate the water from the steam. The steam leaves the unit through outlet 26, and the water flows down the annular space for mixing with the water entering the shell 20 through inlet 22.

Figure 2:
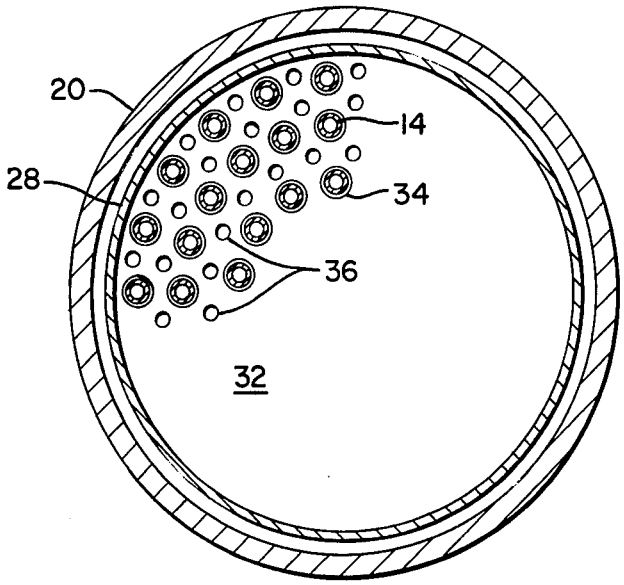
FIG. 2 is a view taken on line 2—2 of FIG. 1, showing a tube support.

Positioned at a number of vertical locations throughout the vessel are a series of tube supports 30. These supports, which are for the purpose of preventing tube vibration induced by the fluid flowing on the shell side of the heat exchanger may be drilled plates 32 as shown in FIG. 2, having oversized holes 34 therein, so that they not only keep the tubes in place and prevent vibration, but also permit flow therethrough. If desired, additional flow holes 36 are formed in the plate 32 to permit flow of the heated fluid therethrough. The tube supports could also be in other forms, for example a grid made up of strips or bars of metal, such as shown in U.S. Pat. No. 3,941,188, if desired.

Regardless of the type of tube support used, there exist areas of tight clearance between the tube and support which are hereafter referred to as "crevices". Without the use of this invention, in many instances, the shell side fluid which flows through the crevices is partially or wholly evaporated by the heat transferred from the tube side to the shell side fluid. One consequence of the evaporation process is that the concentration of dissolved solids in the liquid phase may reach the saturation limit so that further evaporation of water will result in precipitation of solids on the tube and plate surfaces. The crevice formed by a tube and its support is especially vulnerable to high solids deposition due to partial or total evaporation of the water as it flows through the crevice. The solids accumulation in the crevice is undesirable, as it can lead to complete blockage of flow through the crevice which increases shell side pressure drop and may induce localized tube corrosion or other phenomena which could reduce the service life of the tube.

Figure 3:
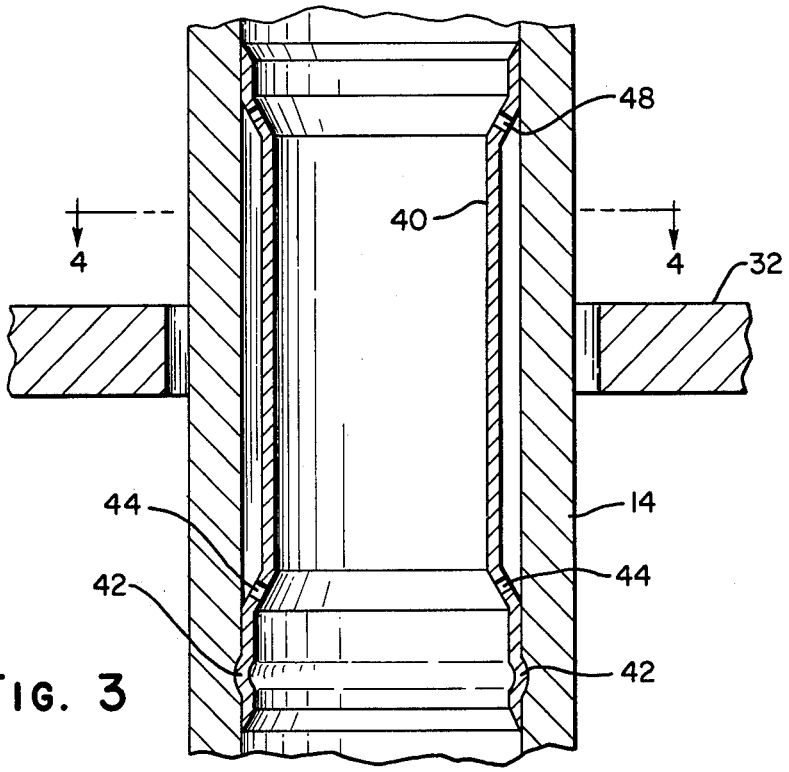
FIG. 3 is a partial elevational cross-section of one of the tubes of the generator at the location of the tube support, showing the insulating sleeve of the invention.
Figure 4:
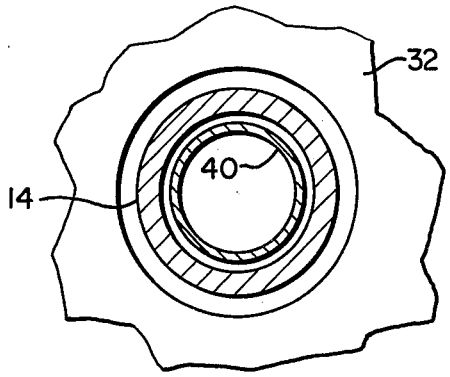
FIG. 4 is a view taken on line 4—4 of FIG. 3.

In order to prevent the above from occurring, a metal insulating sleeve 40 (FIGS. 3 and 4) is positioned inside of each tube at a location adjacent to the support, to minimize the heat flux or heat transfer to the fluid flowing through the crevice between the tube and support. The outer diameter of sleeve 40 is somewhat smaller than the inner diameter of the tube 14, so that a layer of stagnant water is trapped in the annular space therebetween. The stagnant water forms an effective insulating barrier, greatly reducing heat transfer. For example, with the sleeve inserted in a typical ¾" Inconel 600 Pressurized Water Reactor (PWR) steam generator tube, it has been calculated that the localized heat flux in supports near the tube side inlet would be reduced from about 100,000 BTU per hour foot squared to approximately 16,000 BTU per hour foot squared. The geometry of the insulating sleeve is such that most of the static pressure drop due to acceleration of the fluid is recovered.

The insulating sleeve 40 can be secured to the tube 14 in any suitable manner. The preferred method would be to expand the lower end of the sleeve into tight engagement with the tube, as shown at 42. This could be done by using pressurized hydraulic or pneumatic fluid inside a flexible bag that can be inserted in the tube through the opened bottom end. If desired, the top end of the insulating sleeve can also be expanded. Drain holes 44 are located near the bottom of the insulating sleeve 40, to allow the annular space to drain when the unit is not operating. Bleed holes 48 are located at the top to prevent air from becoming trapped behind the sleeves.

Figure 5:
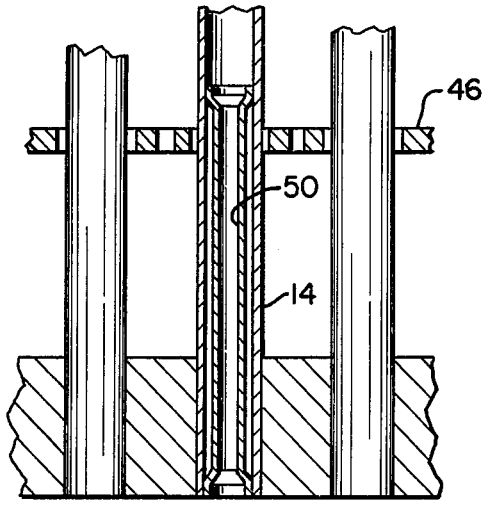
FIG. 5 is an elevational view of the invention applied to a flow distribution baffle.

In some PWR steam generators, a flow distribution plate 46 (FIGS. 1 and 5) is located above the tube sheet 18. This plate is for the purpose of distributing the flow more equally across the entire cross-section of the shell. When such a distribution plate is used, it may be desirable to minimize the heat flux in the entire space between the tube sheet and the distribution plate, in addition to the crevices between the distribution plate 46 and the tubes 18. Thus, the insulating sleeves 50 extend from the tube sheet 18 to a point above the distribution plate 46 in this arrangement. Thus, this arrangement minimizes boiling in the entire space below the distribution plate 46, in addition to the area directly adjacent to the distribution plate.

What is claimed is:

1. In a shell- and tube- heat exchanger for the generation of vapor by the indirect transfer of heat from a heating fluid to a vaporizable liquid, a pressure vessel, means to introduce vaporizable fluid into the bottom portion of the vessel, an outlet near the top through which vapor is discharged, a bundle of tubes positioned within the vessel, means for circulating heating fluid through the tubes, tube support means positioned within the pressure vessel for preventing tube vibration, the tube support means including horizontally positioned means closely surrounding, but slightly spaced from, each tube in the bundle of tubes at a given elevation, each tube containing an insulating sleeve secured within it, each insulating sleeve being smaller than the inner diameter of the tube it is positioned in, so as to form an annular space therebetween, each insulating sleeve being substantially closed at its upstream end regarding flow of heating fluid, so that the annular space is full of stagnant water forming an insulating barrier during operation, each insulating sleeve being at the same elevation as the tube support means.

2. The shell- and tube- heat exchanger of claim 1, wherein each insulating sleeve has drain holes therein near its bottom end.

3. The shell- and tube- heat exchanger of claim 1 wherein there are a plurality of tube support means, located at a plurality of elevations within the vessel, and there are a plurality of insulating sleeves in each tube, there being one located within each tube at each elevation of the tube support means.

4. The shell- and tube- heat exchanger of claim 1, wherein the tube support means is a plate, having a set of holes therein through which the tubes extend, the holes being slightly larger than the outside diameter of the tube.

5. The shell- and tube- heat exchanger of claim 4 wherein there are a second set of holes in the plate through which the vaporizable fluid can flow.

* * * * *